US005584329A

United States Patent [19]

Thomas

[11] Patent Number: 5,584,329

[45] Date of Patent: Dec. 17, 1996

[54] MOVEABLE SHADE FOR PALLADIAN WINDOWS

[76] Inventor: Larry J. Thomas, 1593 Vinings Ct., Lawrenceville, Ga. 30243

[21] Appl. No.: 384,662

[22] Filed: Feb. 6, 1995

[51] Int. Cl.[6] ..... E06B 3/94

[52] U.S. Cl. ..... 160/134; 160/84.07

[58] Field of Search ..... 160/134, 84.07, 160/320, 370.21, 370.23, 210, 113

[56] References Cited

U.S. PATENT DOCUMENTS

| | | | |
|---|---|---|---|
| 553,375 | 1/1896 | Williams | 160/134 |
| 602,967 | 4/1898 | Wells | 160/134 |
| 1,447,189 | 3/1923 | Simon . | |
| 1,609,877 | 12/1926 | Kendall . | |
| 4,699,195 | 10/1987 | Lester . | |
| 4,776,380 | 10/1988 | Lester . | |
| 4,861,090 | 8/1989 | Gavrieli . | |
| 4,934,434 | 6/1990 | Schnebly et al. . | |
| 5,002,112 | 3/1991 | Schnebly et al. . | |
| 5,010,939 | 4/1991 | King . | |
| 5,050,661 | 9/1991 | Sikkema et al. . | |
| 5,086,822 | 2/1992 | Keighler . | |
| 5,117,889 | 6/1992 | Coe . | |
| 5,139,070 | 8/1992 | Kidd . | |
| 5,159,966 | 11/1992 | Fleishman et al. . | |
| 5,168,912 | 12/1992 | Jelic et al. . | |
| 5,183,092 | 2/1993 | Jelic . | |
| 5,207,257 | 5/1993 | Rupel et al. . | |
| 5,341,864 | 8/1994 | Rupel et al. . | |

FOREIGN PATENT DOCUMENTS

| | | | |
|---|---|---|---|
| 815405 | 6/1959 | United Kingdom | 160/134 |

*Primary Examiner*—Blair Johnson
*Attorney, Agent, or Firm*—Hinkle & Associates, P.C.

[57] ABSTRACT

An arched-window shade (1) has a plurality of left-side blades (2) and right-side blades (3) with center ends oppositely disposed and attached pivotally to at least one blade axle (7, 8, 28) positioned centrally on a sill (4) of an arched window (5). The left blades are juxtaposed side-by-side and linked together consecutively with at least one left link line (24) and the right blades are juxtaposed side-by-side and linked together consecutively with at least one right link line (25). A left draw string (11) is attached to a select one of the left blades at a design distance from its center end and a right draw string (12) is attached to a select one of the right blades at a design distance from its center end. The draw strings are routed over a lift support (18, 30, 31) positioned centrally above the at-least-one blade axle, then downward and outward on line supports (19, 20, 22, 23). The left blades of the shade are opened and closed by raising and lowering the left draw string. The right blades of the shade are opened and closed by raising and lowering the right draw string. Balance of weight between the blades and weighted handles (13, 14) in combination with friction between the lift supports and the draw strings prevents the blades from falling to open positions of the shade without hand-raising the draw strings separately.

1 Claim, 4 Drawing Sheets

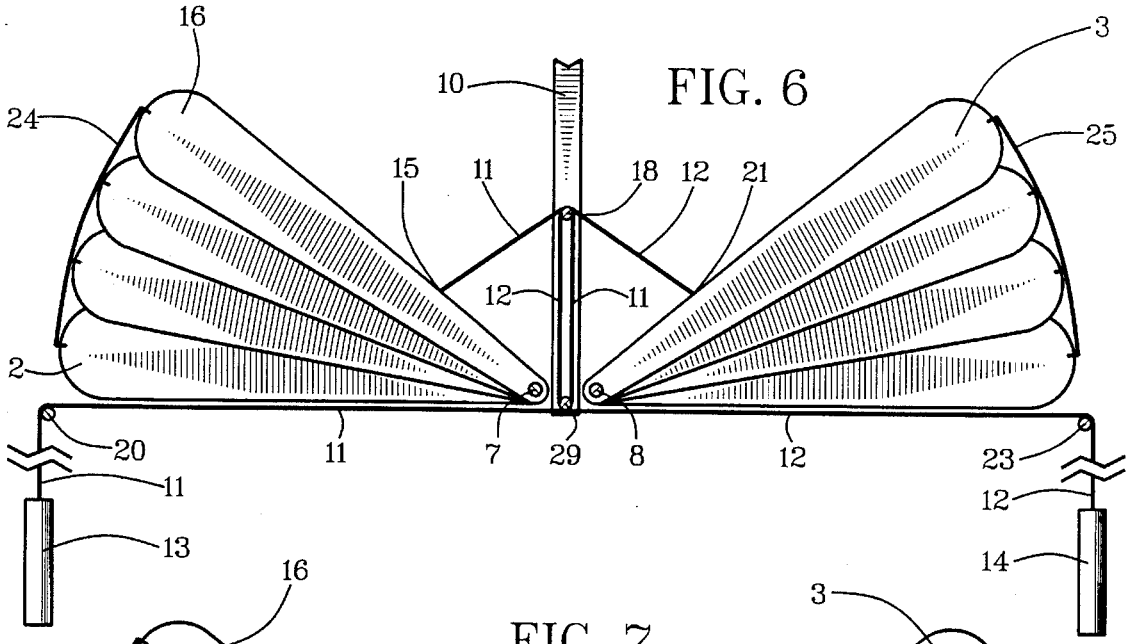
FIG. 6
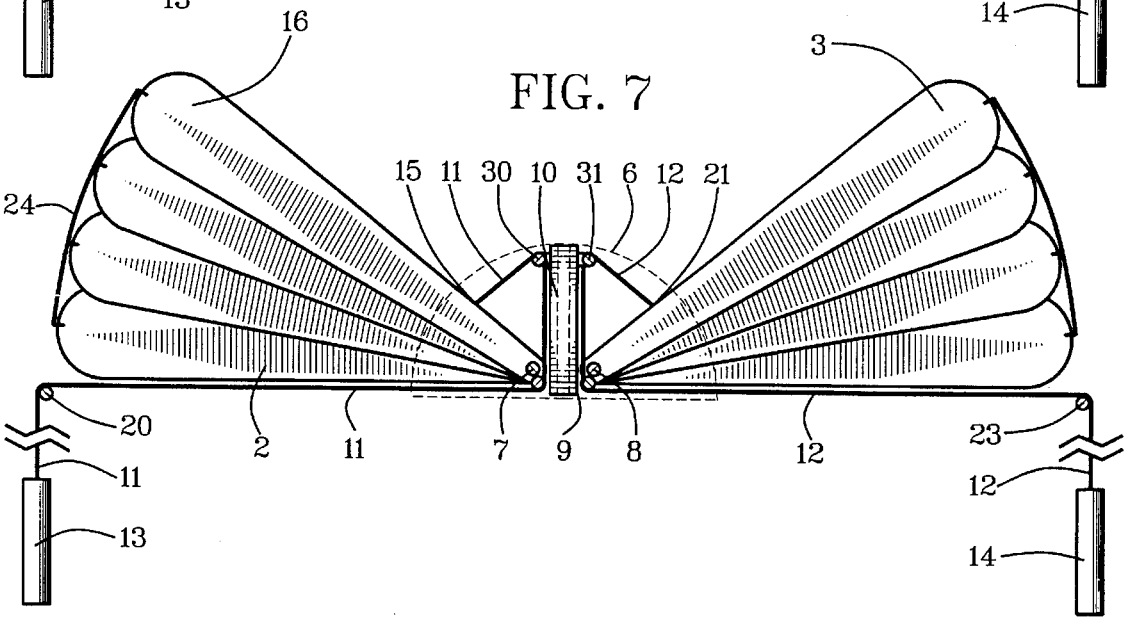
FIG. 7
FIG. 8
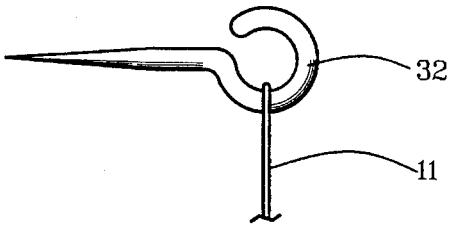
FIG. 9
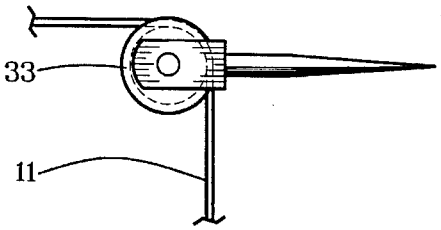

MOVEABLE SHADE FOR PALLADIAN WINDOWS

BACKGROUND OF THE INVENTION

I. Field of the Invention

The present invention relates generally to the field of window shades for arched windows.

II. Description of the Related Art

There are a variety of types of shades for arched windows. The type employed in this invention has blades with center ends attached pivotally at a bottom center of a window arc and outside ends rotated from bottom outside edges of the arc to a top center of the arc. This type is distinguished from other types of arched-window shades that have blades joined centrally and spread like a fan or rotated linearly on an axis like a variable-pitch propeller.

Other arched-window shades that have center ends attached pivotally and outside ends rotated from a bottom outside to a top center of an arched window are different from this invention. Examples are described in the following patent documents. U.S. Pat. No. 5,117,889, issued to Coe on Jun. 2, 1992, is limited to "a track comprising a flexible material capable of being bent to a curve corresponding to the shape of said arch shaped window and defining a channel". A plurality of "trolleys" were disposed in the channel to cause blades to conform to the arch-shaped window. The instant device does not have such channel. Instead it employs other means for guiding travel of the blades. It also employs other means for raising and lowering the blades and other materially different features. U.S. Pat. No. 4,776,380, issued to Lester on Oct. 11, 1988, and U.S. Pat. No. 4,699,195, issued to Lester on Oct. 13, 1987, were both limited to a "U-shaped channel" at the bottom of a semi-circular portion of an arched window. Other limitations were first and second tapes extending between successive blades, tensioning means in communication between the U-shaped channel and the tapes, curved guides in the U-shaped channel and other features different from the device described in this application. U.S. Pat. No. 1,447,189, issued to Simon on Mar. 6, 1923, exemplified linear pivoting, like pitch-adjustment of a propeller, in contrast to rotational pivoting as employed in this invention.

SUMMARY OF THE INVENTION

In accordance with the present invention, it is contemplated that the objectives of this invention are to provide an arched-window shade which:

- Has pull-string opening and closing for each of two opposite sides separately and selectively,
- Can be adjusted to selected openness by mere pulling or lifting of draw strings without separate fastening means, and
- Is convenient to install, inexpensive, long-lasting, easy to maintain, easy to clean and amenable to attractive design.

This invention accomplishes the above and other objectives, wherein an arched-type window is fitted with an arched-window shade having a plurality of blades on the left side of center and a plurality of blades on the right side of center with center ends of the left blades and center ends of the right blades oppositely disposed and attached pivotally to at least one blade axle positioned centrally on a sill of an arched window. The left blades are juxtaposed side-by-side and linked together consecutively with at least one left link line, and the right blades are juxtaposed side-by-side and linked together consecutively with at least one right link line. A left draw string is attached to a select one of the left blades at a design distance from its center end and a right draw string is attached to a select one of the right blades at a design distance from its center end. The draw strings are routed over a lift support positioned centrally above the at-least-one blade axle, then downward and outward on string supports. The left blades of the shade are closed by pulling the left draw string to raise the left blades consecutively upward from a left side of the arched window towards a top center of the arched window. The right blades of the shade are closed by pulling the right draw string to raise the right blades consecutively upward from a right side of the arched window towards the top center of the arched window. The weight of the weighted handles 13 and 14 prevent the blades from falling to open positions of the shade without hand-raising the draw strings separately.

Other objects, advantages and capabilities of the invention will become apparent from the following description taken in conjunction with the accompanying drawings showing preferred embodiments of the invention.

BRIEF DESCRIPTION OF THE DRAWINGS

FIG. 6 is a plan view of an operational means with a single top line-pivot member;

FIG. 7 is a plan view of an operational means with separate left and right top line-pivot members;

FIG. 8 is an elevation view of an eye bolt used as a pivot member;

FIG. 9 is an elevation view of a pulley bolt used as a pivot member;

DESCRIPTION OF THE PREFERRED EMBODIMENTS

Figure 1:
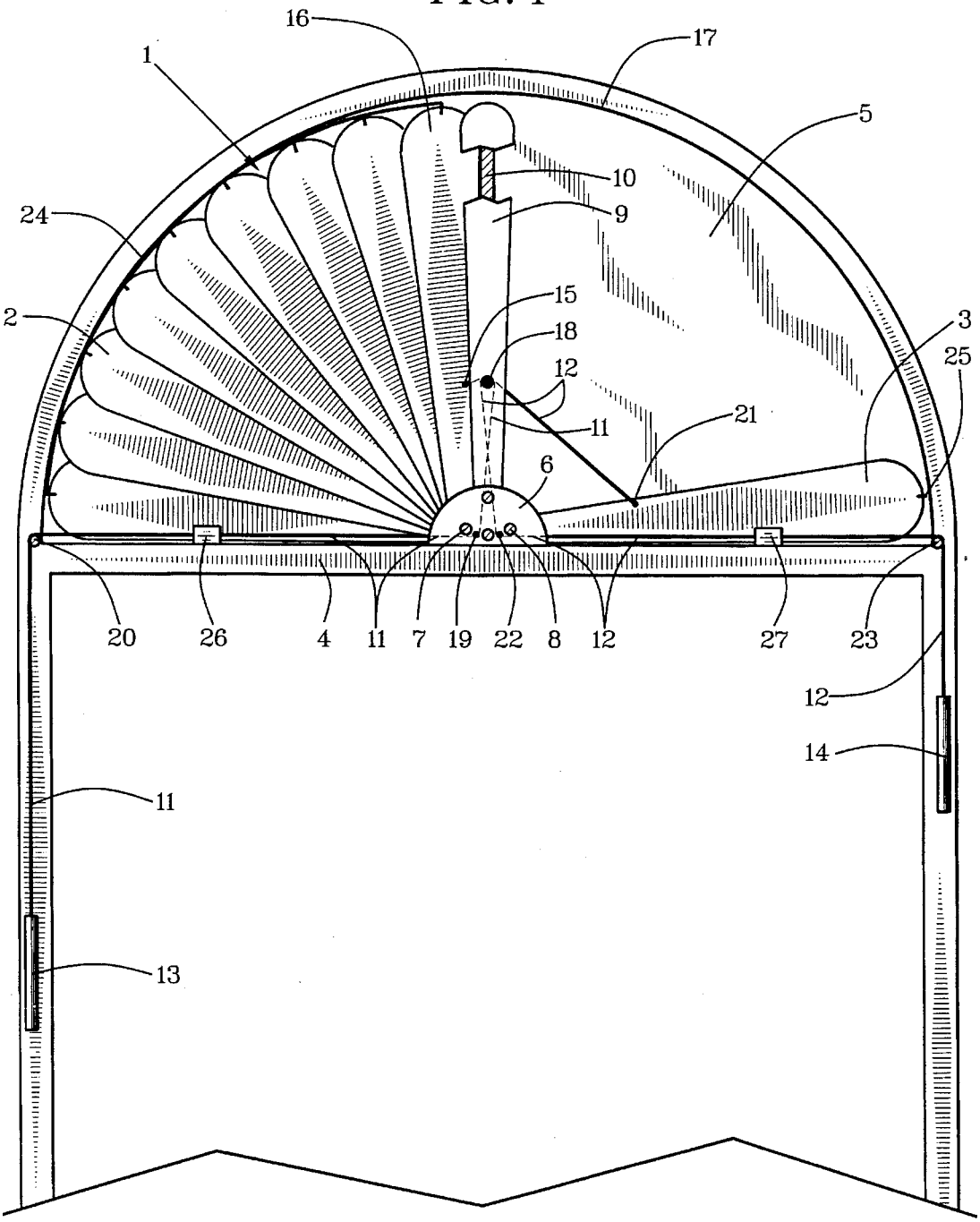
FIG. 1 is a front elevation view of a double-axle embodiment with partial cutaway.
Figure 2:
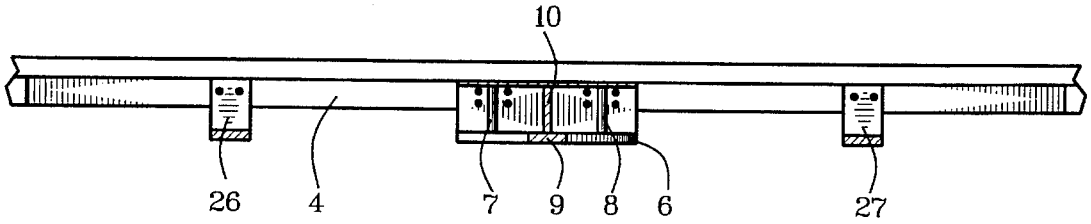
FIG. 2 is a top view of a double-axle embodiment without blades attached.
Figure 3:
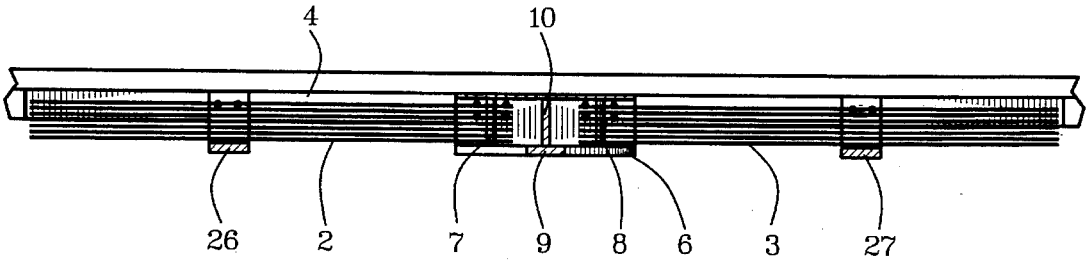
FIG. 3 is a top view of the FIG. 3 illustration with blades attached.

Referring to the drawings wherein like reference numerals designate corresponding parts throughout the several figures, reference is made first to FIG. 1. An arched-window shade 1 has a plurality of left-side blades 2 and a plurality of right-side blades 3. The plurality of left-side blades 2 are juxtaposed side-by-side on a left side of a window sill 4 of an arched window 5. The plurality of right-side blades 3 are juxtaposed side-by-side on a right side of the window sill 4 of the arched window 5. A shade bracket 6 positioned centrally on the window sill 4 has a left shade axle 7 to which center ends of the left-side blades 2 are pivotally attached and a right shade axle 8 to which center ends of the right-side blades 3 are attached pivotally. Extending perpendicularly from the window sill 4 proximate the shade bracket 6 is a support rod 9 having a blade-restraint section 10.

The arched-window shade 1 is operated by arcuately raising and lowering the left-side blades 2 to close and to open a left side, and by arcuately raising and lowering the right-side blades 3 to close and to open the right side separately. The left-side blades 2 are raised by pulling a left draw string 11 and lowered by raising the left draw string 11. The right-side blades 3 are raised by pulling a right draw string 12 and lowered by raising the right draw string 12. A left weighted handle 13 is attached to a proximal end of the left draw string 11 and a right weighted handle 14 is attached to the proximal end of the right draw string 12.

A distal end 15 of the left draw string 11 is attached to a leading left blade 16 at a design position intermediate an inside end that is attached pivotally to the left shade axle 7 and an outside end that is proximate a border arc 17 of the arched window 5. The left draw string 11 is routed first in circumferential contact with a top line-pivot member 18 that is attached to the support rod 9 and extended horizontally at a position vertically above the window sill 4. Then the left draw string 11 is routed secondly in circumferential contact with an inside left-bottom line-pivot member 19 and then routed thirdly in circumferential contact with an outside left-bottom line-pivot member 20 from which the left draw string 11 is suspended to the left weighted handle 13. In like manner on a right side of the arched window 5, a distal end 21 of the right draw string 12 is attached to a right-side blade 3, which is a leading right blade in this illustration, at a design position intermediate an inside end that is attached pivotally to the right shade axle 8 and an outside end that is proximate the border arc 17 of the arched window 5. The right draw string 12 is routed first in circumferential contact with the top line-pivot member 18. Then the right draw string 12 is routed secondly in circumferential contact with an inside right-bottom line-pivot member 22 and then routed thirdly in circumferential contact with an outside right-bottom line-pivot member 23 from which the right draw string 12 is suspended to the right weighted handle 14.

When only one top line-pivot member 18 and two bottom line-pivot members 19 and 22 are employed, it is necessary to cross the draw strings 11 and 12 at some point, such as shown by their representation as dashed lines that cross intermediate the top line-pivot member 18 and the bottom line-pivot members 19 and 22. Use of separate line-pivot members without crossing draw strings 11 and 12 is described in relation to FIGS. 6–7.

For either line-pivot arrangement, pulling the left draw string 11 pulls it in circumferential contact with the outside left-bottom line-pivot member 20, in circumferential contact with the inside left-bottom line-pivot member 19, in circumferential contact with the top line-pivot member 18, and finally in opposition to gravity of the leading left blade 16 and all other left-side blades 2 which are lifted by a left link line 24. Likewise on the right side of the arched window 5, pulling the right draw string 12 pulls it in circumferential contact with the outside right-bottom line-pivot member 23, in circumferential contact with the inside right-bottom line-pivot member 22, in circumferential contact with the top line-pivot member 18, and finally in opposition to gravity of a right blade 3 to which other right blades 3 are attached with a right link line 25. The left link line 24 and the right link line 25 are attached to consecutive left blades 2 and right blades 3 with length of the respective link lines 24 and 25 between the blades 2 and between the blades 3 being designed to separate the blades 2 and the blades 3 with a design amount of overlap as shown when a lead blade 2 or 3 is raised.

The line-pivot members 18, 19, 20, 22, and 23 can be provided with sufficient frictional resistance to travel of the respective draw strings 11 and 12 to prevent movement of the blades 2 and 3 independently of raising or lowering the weighted handles 13 and 14. This can be achieved by a selection of eye-bolts and/or pulleys as shown in FIGS. 8–9. Circumferential contact of the draw strings 11 and 12 with the line-pivot members 18, 19, 20, 22, and 23 respectively is whatever frictional or pulley-wheel supportive contact is employed for different types of line-pivot members. Circumferential rods in approximately 90-degree contact with the draw strings 11 and 12 are the simplest forms, but not necessarily preferred forms, of line-pivot members 18, 19, 20, 22, and 23.

A left-stack bracket 26 and a right-stack bracket 27 can be employed to support outside ends of the blades 2 and 3 respectively.

Figure 4:
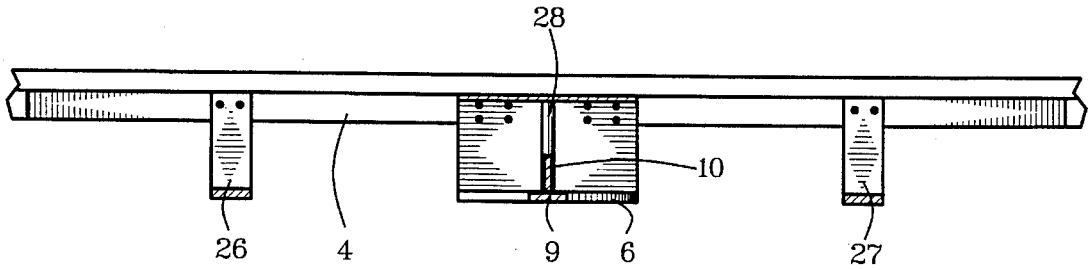
FIG. 4 is a top view of a single-axle embodiment without blades attached.
Figure 5:
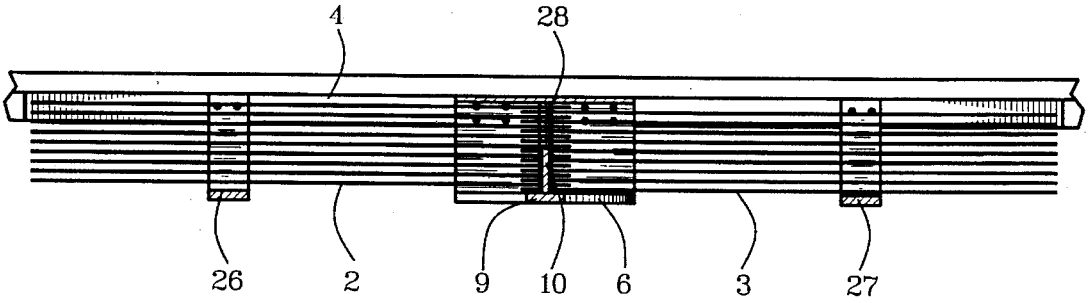
FIG. 5 is a top view of the FIG. 3 illustration with blades attached.

Reference is made now to FIGS. 2–5. The left shade axle 7 and the right shade axle 8 are shown extending from the shade bracket 6 on the window sill 4 in a top view without the left-side blades 2 and the right-side blades 3 attached in FIG. 2 and with the left-side blades 2 and the right-side blades 3 attached in FIG. 3. In FIG. 4, a single axle 28 is shown without left-side blades 2 or right-side blades 3 attached. In FIG. 5, inside ends of the left-side blades 2 and right-side blades 3 are attached pivotally to the single axle 28. For the single axle 28, however, the shade bracket 6 must be wider to contain inside ends of the blades 2 and 3 in overlapped, juxtaposed relationship. A noted advantage of the double-axle embodiment of FIGS. 2–3, therefore, is thinness of side-stacked blades 2 and 3 on the brackets 6, 26 and 27 that are positionined on the window sill 4. Its disadvantage is non-conformity of its outside edges to a circular arc of an arched window 5. The single-axle embodiment of FIGS. 4–5 can conform to a circular arc but protrudes further into a room from the arched window 5.

Referring to FIGS. 1 and 6, a single inside-bottom line-pivot member 29 can be employed by positioning the draw strings 11 and 12 side-by-side in circumferential contact with the single inside-bottom line-pivot member 29 intermediate circumferential contact with the top line-pivot member 18, the outside left-bottom line-pivot member 20 and the outside right-bottom line-pivot member 23 respectively. The draw strings 11 and 12 are parallel between and at opposite sides of the single inside-bottom line-pivot member 29 and the top line-pivot member 18 from the shades 2 and 3 to which they are attached to as shown. They cross side-by-side on the pivot members 18 and 29.

Referring to FIGS. 1 and 6–7, the support rod 9 and the blade-restraint section 10 are positioned to lie in the same plane as the shade bracket 6. All operative mechanism, therefore, can be hidden by the shade bracket 6. The left link line 24 and the right link line 25 also can be attached to back portions of the blades 2 and 3 in positions not visible from a front of the arched-window shade 1.

A left-top line-pivot member 30 and a right-top line-pivot member 31 can be employed in place of the single top line-pivot member 18 regardless of whether a single inside-bottom line-pivot member 29 or an inside left-bottom line-pivot member 19 together with an inside right-bottom line-pivot member 22 are employed. Top line-pivot member 18 is interchangeable with a combination of a left-top line-pivot member 30 and a right-top line-pivot member 31 and a single inside-bottom line-pivot member 29.

Figure 11:
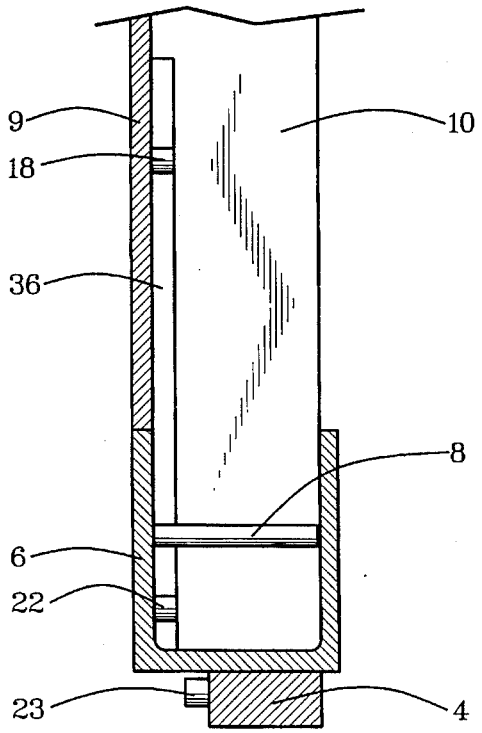
FIG. 11 is a side elevation view of a shade bracket and a support rod on a window sill.

Referring to FIGS. 8–9 and 11, either or all of the line-pivot members 18, 10, 20, 22, and 23 can be eye bolts 32 as shown in FIG. 8, pulleys 33 as shown in FIG. 9 or circumferential rods as depicted in FIG. 11 for separate types of line-pivot members 18, 22 and 23. For design tradeoff, circumferential rods and eye bolts 32 are less expensive and easier to construct. Pulleys 33, however, cause the draw strings 11 and 12 to last longer, are more user-friendly, and are more amenable to friction control in balancing weight of the weighted handles 13 and 14 against weight of the blades 2 and 3. Different types of line-pivot members 18, 19, 20, 22, and 23 are represented by a simple circle or rod in all Figures except FIGS. 8–9 to include either type that can be used. The draw strings 11 and 12, where they attach to the leading edge of the leading blades, will be hidden from view, when the blades are in the closed position, by the support rod 9. Also, the draw strings will be routed in 36 behind support rod 9 so that the strings are maintained close thereto for operation and aesthetic purposes.

Figure 10:
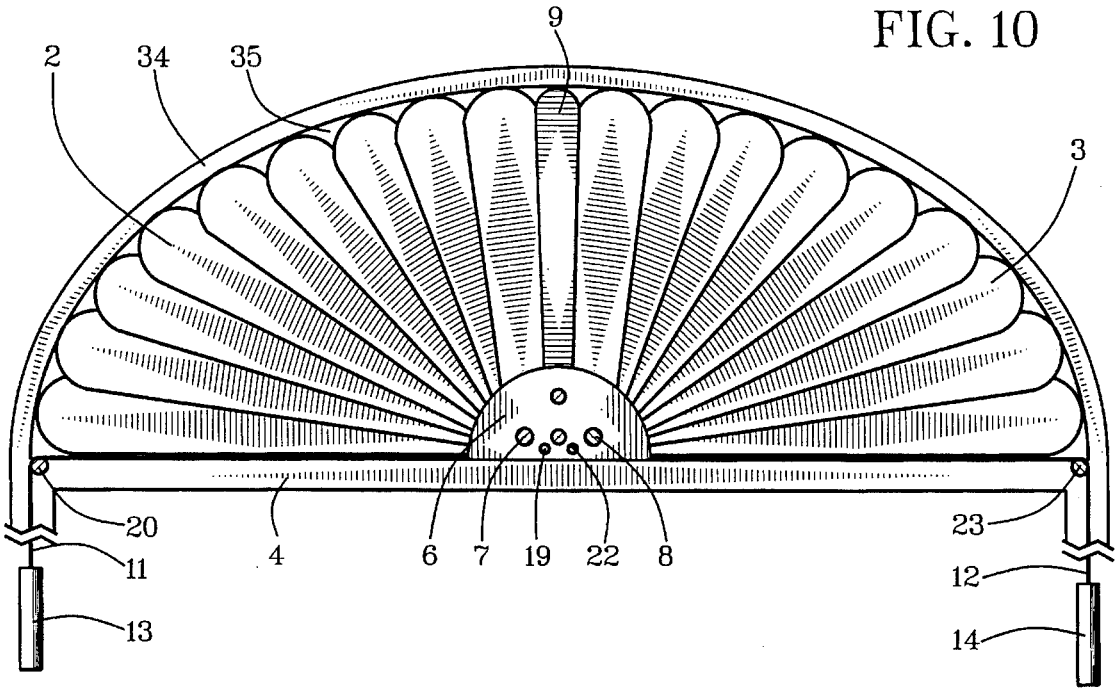
FIG. 10 is an elevation view of an elliptical-arc embodiment.

Referring to FIG. 10, the left-side blades 2 and the right-side blades 3 can be graduated in length to fit in an elliptical border arc 34 for an elliptically arched window 35. Other factors are the same as for arched windows 5 as described in relation to FIGS. 1–9 and 11.

Various modifications may be made of the invention without departing from the scope thereof and it is desired, therefore, that only such limitations shall be placed thereon as are imposed by the prior art and which are set forth in the appended claims.

What is claimed is:

1. An arched-window shade comprising:

a plurality of first-side blades comprising a set of blades having center ends and outside ends and juxtaposed side-by-side, a plurality of second-side blades comprising a set of blades having center ends and outside ends and juxtaposed side-by-side, the center ends of the first-side blades are interspersed with center ends of the second-side blades, the first-side blades and the second-side blades have varying lengths, the set of first-side blades and the set of second-side blades each have a leading blade and a plurality of consecutive blades, the leading blade of both the set of first-side blades and the set of second-side blades being of a first length, the trailing blades of the first-side blades and the second-side blades having consecutively greater length than the leading blade, a shade bracket positioned centrally to the first-side blades and to the second-side blades and having at least one shade axle to which the center ends of the first-side blades and the second-side blades are attached pivotally, the at-least one shade axle is a pair of axles comprised of a first shade axle positioned to a first-side of the shade bracket and a second shade axle positioned to a second-side of the shade bracket, a first-side link line with which the first-side blades are linked together consecutively, a second-side link line with which the second-side blades are linked together consecutively, the first-side link line and the second-side link line are attached to outside ends of first-side blades and second-side blades respectively, a first draw string attached to a predetermined first-side blade, a second draw string attached to a predetermined second-side blade, the predetermined first-side blade is a leading blade and the predetermined second-side blade is a leading blade, the first draw string is attached to the leading first-side blade and the second draw string is attached to the leading second-side blade at positions that provide leverage for pulling and lifting of the first draw string and the second draw string separately to open and to close the arched-window shades, a draw-string weight on a handle end of the first draw string and a draw-string weight on a handle end of the second draw string, a support rod extended vertically upward from a position proximate the shade bracket to a predetermined position, the support rod has a blade-restraint section to limit the travel of first-side blades and the second-side blades, the support rod is positioned behind a front of the shade bracket and extends vertically upward, the first draw string and the second draw string being routed first in circumferential contact with at least one top line-pivot member that is attached to the support rod, the at-least-one top line-pivot member is a single support structure having an arcuate surface on which the first draw string and the second draw string are positioned in sliding contact to be routed first, an inside first-bottom line-pivot member positioned proximate a first side of a bottom of the support rod, an outside first-bottom line-pivot member, the first draw string being routed secondly in circumferential contact with the inside first-bottom line-pivot member and being routed thirdly in circumferential contact with the outside first-bottom line-pivot member such that downward pulling of the first draw string lifts the predetermined first-side blade and the first-side link line lifts the first-side blades consecutively and selectively, an inside second-bottom line-pivot member positioned proximate a second side of a bottom of the support rod, an outside second-bottom line-pivot member, and the second draw string being routed secondly in circumferential contact with the inside first-bottom line-pivot member and being routed thirdly in circumferential contact with the outside second-bottom line-pivot member such that downward pulling of the second draw string lifts the predetermined second-side blade and the second-side link line lifts the second-side blades consecutively and selectively.

* * * * *